United States Patent [19]

Erdmenger et al.

[11] 4,087,863

[45] May 2, 1978

[54] MIXER

[75] Inventors: Rüdolf Erdmenger, Bergisch-Gladbach; Martin Ullrich, Leverkusen, both of Germany

[73] Assignee: Bayer Aktiengesellschaft, Leverkusen, Germany

[21] Appl. No.: 564,393

[22] Filed: Apr. 2, 1975

[30] Foreign Application Priority Data

Apr. 23, 1974 Germany ..... 2419498

[51] Int. Cl.[2] ..... B01F 7/32

[52] U.S. Cl. ..... 366/305; 366/306

[58] Field of Search ..... 259/120, 122, 121, 8, 259/104, 107, 108, 118, 119, 23, 24, 43, 44, 7, 9, 10

[56] References Cited

U.S. PATENT DOCUMENTS

| | | | |
|---|---|---|---|
| 1,247,655 | 11/1917 | Frame | 259/105 |
| 3,195,867 | 7/1965 | Mould | 259/9 |
| 3,281,124 | 10/1966 | Pawlowski | 259/8 |
| 3,361,537 | 1/1968 | Ferrante | 259/8 |
| 3,392,963 | 7/1968 | Van | 259/105 |
| 3,508,882 | 4/1970 | Farnell | 259/8 |
| 3,801,286 | 4/1974 | Anolick | 259/108 |

*Primary Examiner*—Robert W. Jenkins

*Attorney, Agent, or Firm*—Burgess, Dinklage & Sprung

[57] ABSTRACT

Differences in the rates of flow of media flowing through vessels are equalized by a mixer which consists of a basket-like rotating framework slightly smaller in external diameter than the internal diameter of the tubular vessel, and which comprises a central, stationary column.

8 Claims, 4 Drawing Figures

MIXER

This invention relates to a mixer comprising a cylindrical housing having a stirrer arranged concentrically therein.

German Patent Specification No. 1,202,251 relates to a mixer which is used as a flow-equalising mixer in continuous-flow and laminar-flow vessels for polymerisation or similar reactions, the components present being required to have a narrow residence-time spectrum in contrast to the known flow rate difference between the peripheral layers of a liminar-flow liquid in the free tube and the substance in the middle of the tube. However, in order to control continuous reactions and their heat effects, it is essential to equalise not only the differences in residence time, but also radial concentration and temperature differences in the reaction tube, i.e. an area of radial velocity components.

According to the invention, there is provided a mixer comprising a cylindrical housing having a stirrer arranged concentrically therein, the stirrer comprising a drive pin which is arranged substantially axially in the housing and which, outside the housing, is connected to a drive and, inside the housing, to a supporting ring upon which several rings are supported and arranged at intervals from one another perpendicularly of the axis of rotation of the stirrer, adjacent rings being joined together by bars in such a way that a triangle is formed by two adjacent bars and the ring section between them, so that the stirrer is in the form of a framework consisting of triangles, and a stationary column centrically arranged in the housing.

The advantage of this arrangement over the arrangement known from German Patent Specification No. 1,202,251 is that an intensified, local velocity gradient is formed between the rotating hollow cylinder and the fixed column, contributing towards radial liquid convection, i.e. towards better mixing of the liquid flowing inside the vessel with its peripheral zone flowing along the walls of the vessel. A second advantage of incorporating the fixed column is that it slows down those parts of the liquid flowing along the centre of the reaction tube, thereby equalising axial velocity differences in the required manner.

In one preferred embodiment, the column is made up of a framework of triangles in the same way as the stirrer. Advantageously the column is provided with lateral arms and/or spiral baffles.

In another particular embodiment, the column consists of a shaft provided with lateral arms and/or spiral baffles. By these features a better radial convection is reached.

The stirrer and column may be made either of solid material or of hollow material. In the latter case, a heating medium or coolant may be passed through the column by providing appropriate inlets and outlets.

The stirrer and column should be substantially stiff against flexure and torsion in order to be able to withstand the forces occurring in very viscous liquids.

In order to increase the stability of the stirrer and to avoid any rocking motion, the stirrer may be mounted in a bearing ring, preferably at its open end.

Two exemplary embodiments of the mixer according to the invention are illustrated by way of example in the accompanying drawings, wherein.

Figure 1:
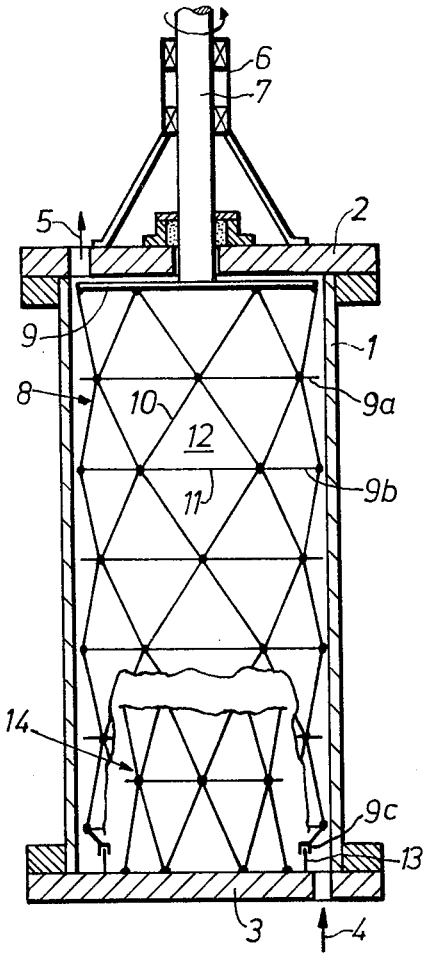
FIG. 1 is a longitudinal section through a first exemplary embodiment with a frame-like column.
Figure 2:
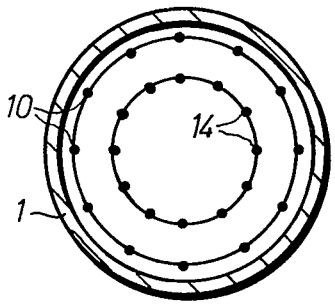
FIG. 2 is a cross-section through the embodiment illustrated in FIG. 1.

As shown in FIGS. 1 and 2, the mixer consists of a tubular vessel 1 with a cover 2 and a base 3. The base 3 is formed with an inlet 4, whilst an outlet 5 is formed in the cover 2. The cover 2 also carries a mounting 6 for a drive and bearing pin 7 of a stirrer 8. Inside the vessel 1, the bearing pin 7 is connected to a supporting ring 9 to which further rings **9*a* and 9*b* are arranged parallel. The adjacent rings 9, 9*a* and 9*b* are joined together by bars 10 in such a way that two bars 10 and a ring section 11 between them form a triangle 12. In this way, the stirrer as a whole is in the form of a basket-like framework of triangles 12. The ring 9*c* nearest the base 3 is guided by a bearing ring 13 in order to avoid rocking movements. A central column 14 is fixed to the base 3, being built up as a framework in the same way as the stirrer 8**.

Figure 3:
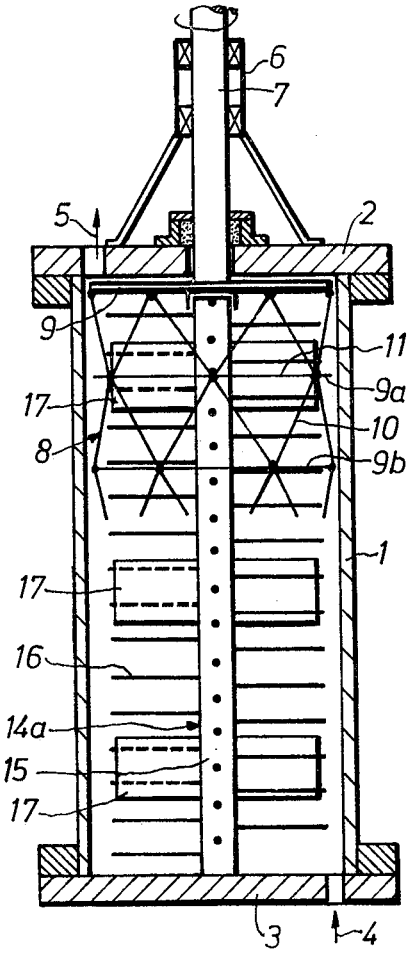
FIG. 3 is a longitudinal section through a second exemplary embodiment of the mixer with a shaft comprising lateral arms.
Figure 4:
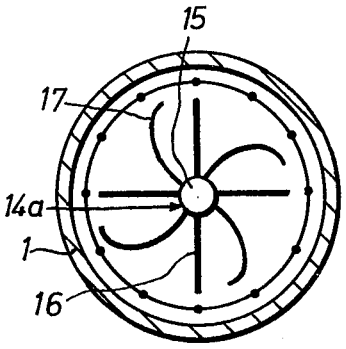
FIG. 4 is a cross-section through the second exemplary embodiment illustrated in FIG. 3.

As shown in FIGS. 3 and 4, the housing 1 and stirrer 8 are identical in every respect with the embodiment shown in FIGS. 1 and 2. However, a column **14*a* of the embodiment illustrated in FIGS. 3 and 4 consists of a central shaft 15 equipped with lateral arms 16 and spiral baffles 17. It is obvious that the shaft 15 need only be equipped with either lateral arms 16 or baffles 17**.

We claim:

1. A flow through mixer comprising a cylindrical housing having an inlet at one end and an outlet at the other end and a stirrer arranged concentrically within the housing, the stirrer comprising a drive pin which is arranged substantially axially in the housing and which, outside the housing, comprises means for connection to a drive, and, inside the housing, is connected to a supporting ring disposed perpendicular to the axis of rotation of the stirrer, the stirrer further comprising a plurality of rings disposed at intervals from one another perpendicular to the axis of rotation of the stirrer, and bars joining together adjacent rings so that each two adjacent bars and a ring section between them form a triangle and so that the stirrer is in the form of a substantially cylindrical framework composed of triangles, and a stationary column concentrically arranged in the housing within said framework.

2. A mixer as claimed in claim 1, wherein the column is also made up of a framework of triangles.

3. A mixer as claimed in claim 2, wherein the column is provided with lateral arms.

4. A mixer as claimed in claim 2, wherein the column is provided with spiral baffles.

5. A mixer as claimed in claim 1, wherein the column comprises of a shaft provided with lateral arms.

6. A mixer as claimed in claim 1, wherein the column comprises of a shaft provided with longitudinally extending spiral baffles.

7. A mixer as claimed in claim 1, wherein the stirrer is mounted in a bearing ring at its lower end.

8. A mixer as claimed in claim 5, wherein the column comprises a shaft provided with longitudinally extending spiral baffles.

* * * * *